United States Patent [19]

Van Winkle

[11] 4,407,361

[45] Oct. 4, 1983

[54] TOOL TRAP

[76] Inventor: D. Wayne Van Winkle, P.O. Box 79727, Houston, Tex. 77079

[21] Appl. No.: 297,033

[22] Filed: Aug. 27, 1981

[51] Int. Cl.[3] ..... E21B 33/068

[52] U.S. Cl. ..... 166/85; 166/243

[58] Field of Search ..... 125/85; 166/83, 85, 166/84, 75 R, 243; 294/86.15, 86.26, 86.3, 86.33

[56] References Cited

U.S. PATENT DOCUMENTS

| | | | |
|---|---|---|---|
| 2,317,306 | 4/1943 | Smith | 175/85 X |
| 3,152,829 | 10/1964 | Steel, Sr. | 294/86.3 |
| 4,004,835 | 1/1977 | Taylor | 294/86.33 |
| 4,299,280 | 11/1981 | Greer | 166/75 R |

FOREIGN PATENT DOCUMENTS

| | | | |
|---|---|---|---|
| 40203 | 7/1958 | Poland | 166/84 |

*Primary Examiner*—Stephen J. Novosad
*Assistant Examiner*—Joseph Falk
*Attorney, Agent, or Firm*—Jack W. Hayden

[57] ABSTRACT

Housing means are adapted to be secured adjacent the upper end of a well bore with latch means supported therein for latching with the fishing neck on the upper end of a wire line tool when it is retrieved from the well bore. The housing means includes release means constructed and arranged to unlatch and maintain the latch means unlatched from the fishing neck on the upper end of the wire line tool when desired.

8 Claims, 6 Drawing Figures

TOOL TRAP

SUMMARY OF THE INVENTION

In the drilling of oil, gas and other type of well bores, it is sometimes desirable to lower a tool on a wire line into the well bore. In some instances, the tool may be lowered through a tubing head on the well bore, but preferably the tool is generally lowered on a wire line through what is termed a lubricator that is mounted on top of a well head at the upper end of the well bore.

Heretofore, it has been customary to provide a tool trap, either in the lubricator or otherwise positioned adjacent the upper end of a well bore, which includes a housing with a bore having a closure member for the bore through the housing. When the tool to be trapped is moved upwardly against such closure, it opens to permit the tool supported by the wire line to move therepast, whereupon spring force moves such closure to close off the bore through the housing and trap the tool thereabove.

Such construction is disadvantageous in that the lower end of the trapped tool may be spaced from the closure and if, upon retrieving the tool upwardly it should contact the upper end of the lubricator or other receptacle at the top of the well bore with sufficient force so as to sener the wire line on which it is supported, it then drops down and impacts against the closure. This is undesirable where sensitive tools may be employed and may cause damage thereto.

Also, such construction is disadvantageous in that a different size closure must be used for each different size of tool which is to be lowered on a wire line in a well bore, and substitution of one housing size and closure size in lieu of another housing and closure size is time-consuming and expensive.

An object of the present invention is to provide a tool trap wherein the upper end of a tool may be latched or trapped and secured in a lubricator or housing adjacent the upper end of a well bore.

Still another object of the present invention is to provide a tool trap for trapping a tool adjacent the upper end of a well bore and retaining it trapped even though the wire line on which the tool is carried has been severed after the tool has been trapped.

Yet a further object of the present invention is to provide a tool trap that includes components that are releasably secured together so that the wire line or slick line that is used to lower and retrieve the tool from a well bore may be connected to a rope socket and upper end of the tool with which it is connected may be quickly and easily removed from the upper end of a lubricator.

Yet a further object of the present invention is to provide a tool trap which may be employed with all sizes of tools.

Other objects and advantages of the present invention will become more readily apparent from a consideration of the following drawings and description.

DESCRIPTION OF THE PREFERRED EMBODIMENTS

Figure 1:
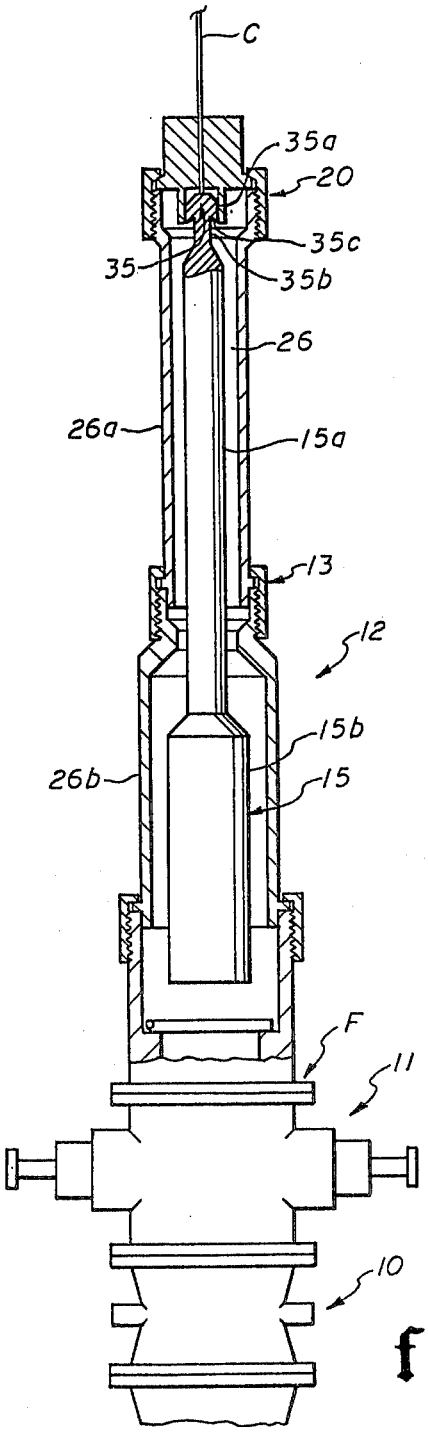
FIG. 1 is a schematic representation illustrating a lubricator secured to a wellhead with one form of the present invention diagrammatically illustrated therewith.

Attention is first directed to FIG. 1 of the drawings wherein a tubing head 10 is illustrated at the top of a production string which extends into a well bore (not shown). Mounted on top of the tubing head 10 is a wire line blowout preventer, referred to by the numeral 11, the construction and function of which is well known to those skilled in the art. Secured to the blowout preventer 11, and extending upwardly therefrom is a lubricator, referred to by the numeral 12. The lubricator is a device which enables a tool, indicated generally at 15, to be lowered into a well bore that is under pressure. The lubricator 12 includes housing means referred to generally at 13 which are of suitable longitudinal extent to include the tool 15 and is provided with suitable seals to inhibit leakage therefrom when positioned as shown in FIG. 1 and in communication with the well bore having fluid under pressure therein. For purposes of description herein, the tool trap of the present invention will be described as it is utilized with a lubricator, but it may be as readily employed with any other type of apparatus with which it may have application.

The tool trap of the present invention is generally referred to by the numeral 20 and is illustrated in FIG. 1 schematically as being connected to the upper end of the lubricator housing 13.

Figure 3:
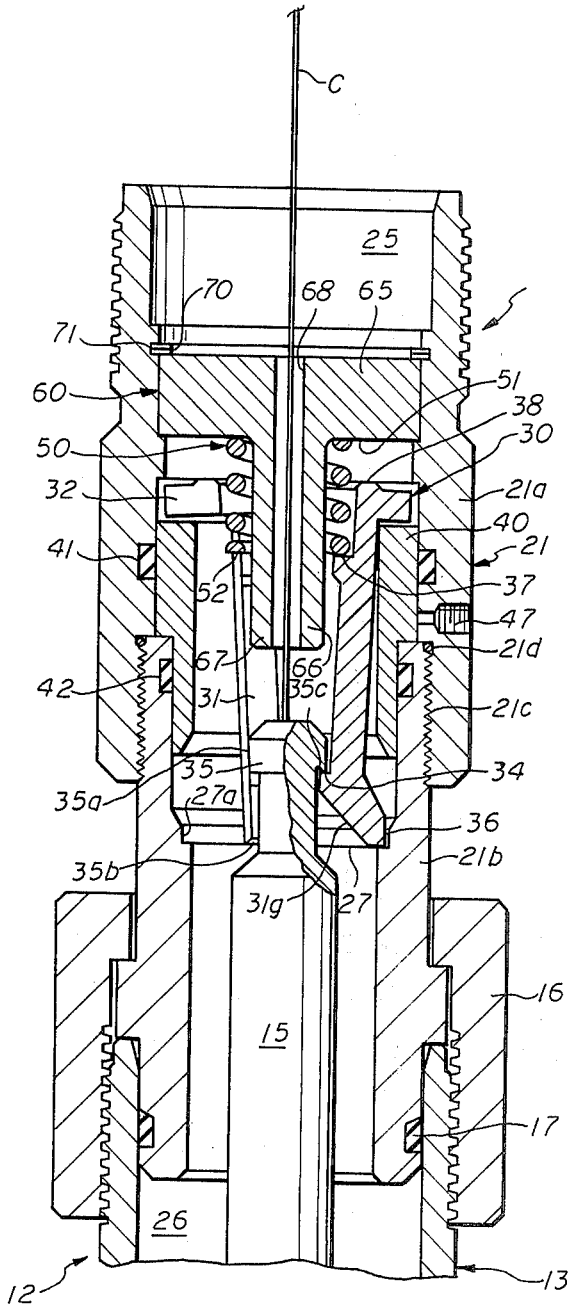
FIG. 3 is a sectional view illustrating a preferred embodiment of the present invention with a tool trapped thereby.

The present invention is again referred to generally by the numeral 20 in FIGS. 3–6, inclusive, and attention is first directed to FIG. 3. Coupling means 16 may be employed to threadedly connect the housing means 21 with the lubricator housing 13 as shown with suitable seal means 17 between the lower end of the housing means 21 and the lubricator housing means 13 to inhibit leakage of fluid under pressure from the lubricator 12. As previously noted, suitable seal means may be provided between the connection of the lubricator housing 13 and the blowout preventer 11 and in various locations throughout the longitudinal extent of the lubricator housing 13, as may be necessary to maintain leakproof integrity.

The housing means 21 is shown as comprising portions **21*a* and 21*b*, which may be threadedly secured together as illustrated at 21*c* with seal means 21*d* to inhibit leakage at the threaded connection. The housing 21** may be formed of any suitable number of components, or may be formed of a unitary construction.

The housing means 21 is provided with a bore 25 extending longitudinally thereof which communicates at its lower end **25*a* with the base 26 in the lubricator 12**.

Figure 2:
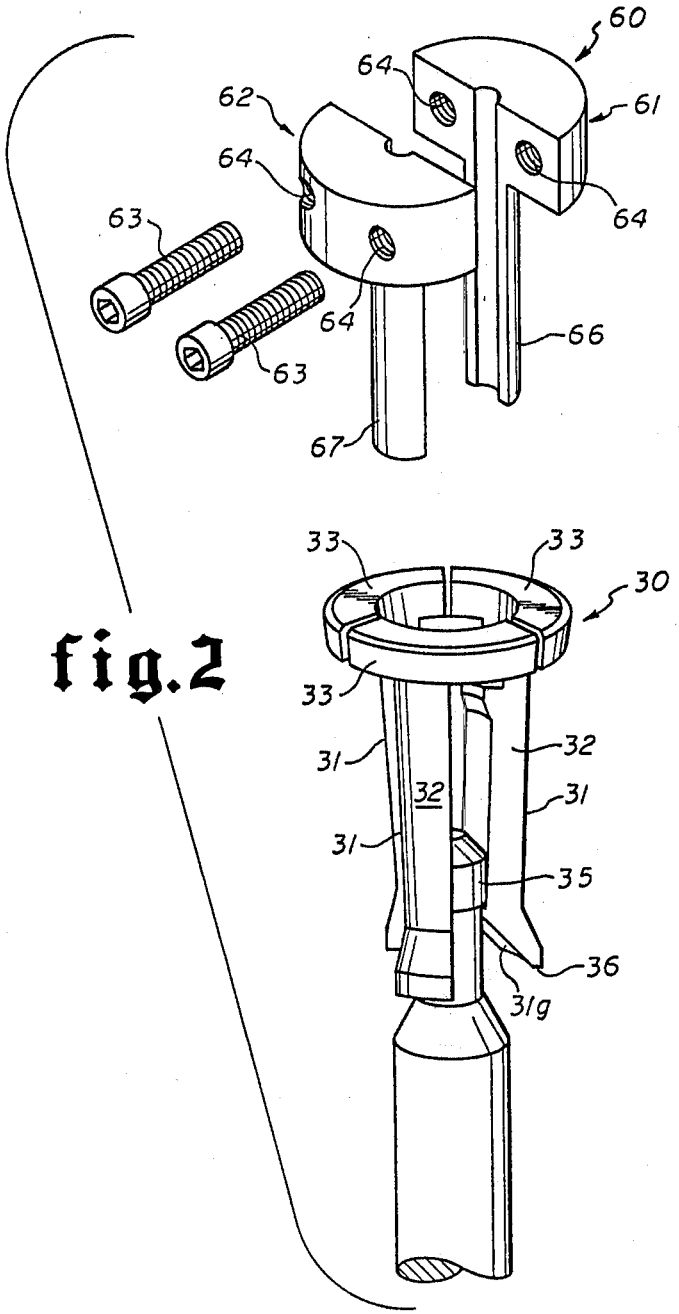
FIG. 2 is an exploded view illustrating in greater detail certain components of the present invention and their relationship.

Latch means referred to generally at 30 are provided in the bore 25 of the housing mean 21 and are supported therein by the latch support means 40 to accommodate longitudinal movement of the latch means 30, as will be described. The latch means 30 comprises a plurality of latch members of any suitable number, three being illustrated in FIG. 2 and designated at 31. Each latch member 31 includes a portion 32 that extends longitudinally of the bore 25, as shown in the drawings, and is provided with an annularly extending portion 32 which projects radially beyond the longitudinally extending portion 32 whereby each latch member 31 may be engaged by the end 41 of the latch support means 40.

Adjacent the lower end of each latch member 31 is a surface or projecting means 34 for engaging with the fishing neck 35 secured adjacent the top of a tool, as illustrated at 15 in the drawings. The fishing neck construction is well known and is used on a number of devices employed in drilling oil and gas wells to enable them to be retrieved from a well bore when desired. As shown it includes a head 35*a* with a reduced neck 35*b* that forms a shoulder 35*c* to be engaged by the projection 34 on latch members 31.

The bore 25 of housing means 21 of the present invention is provided with an annular seat means 27, which projects inwardly of bore 25 and has portion 27*a* of smaller diameter than main bore 25, as shown in the drawings, and portion 27*b* for abutting and seating the lower end 36 of each of the latch members 31 inwardly relative to bore 25 for purposes as will be described.

Spring means 50 abuts at one end 51 against the member 65 which forms part of the support means 60 for spring means 50, and abuts at its other end 52 on the shoulder 37 formed on the longitudinally extending portion 32 of each of the latch members 31 as shown and which also forms part of the support means 60 for spring means 50. It will be noted that the shoulder or ledge means 37 on each of the longitudinally extending portions 32 of the latch means 31 is spaced from the end 38 of each such latch member 31 to provide a cooperating guide arrangement between the spring means 50 and the latch members 31 during functioning of the tool trap of the present invention.

Figure 4:
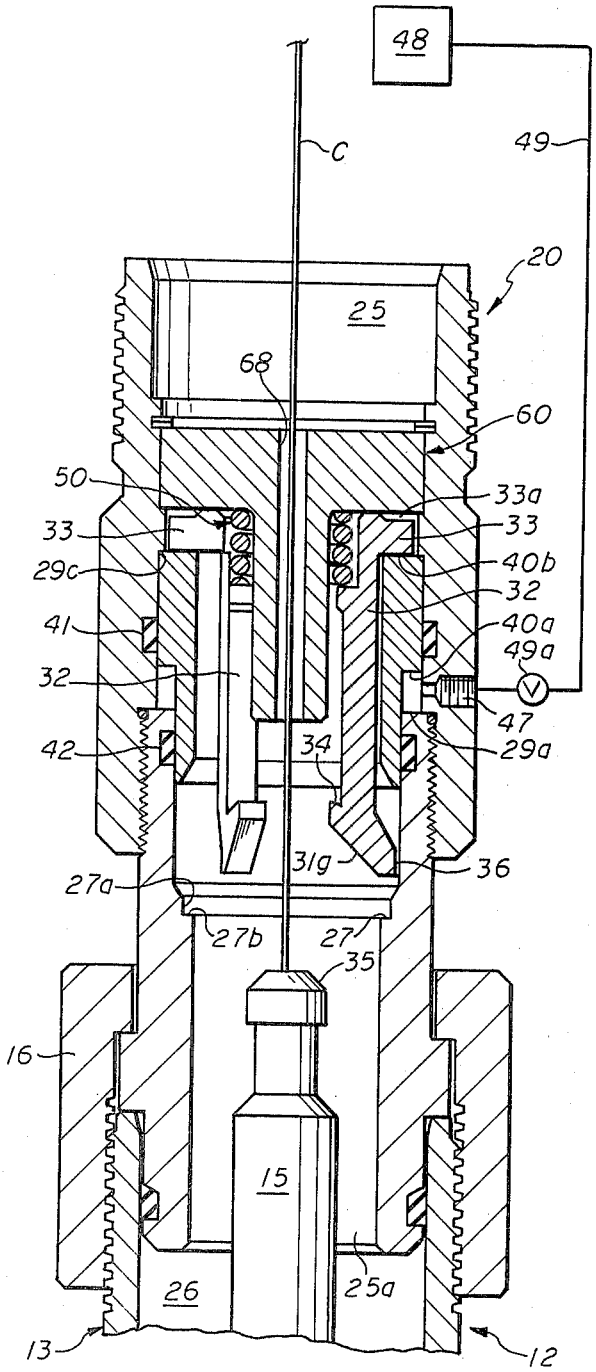
FIG. 4 is a sectional view illustrating the relative position of the components of the tool trap of the present invention after it has been actuated to release and maintain the latch means released from the tool that has been trapped therewith.

It will be further noted that in the FIG. 3 modification the member 65 is formed of a plurality of members, two of which are shown and referred to generally at 61 and 62, which may be releasably secured together in any suitable manner and, as illustrated, may be secured together by means of the bolts 63 extending through the threaded openings 64 formed in each of the semi-circular members 61, 62. When the members 61, 62 are assembled they define the annular member 65 which fits within the bore 25 of the housing means 21. Any suitable projecting means may be provided in association with the annular member 65 to assist in positioning and maintaining the spring 50 and, as illustrated, one suitable arrangement is shown as comprising elongated semicircular portions 66 and 67 integrally formed with the members 61 and 62, respectively. The members 61, 62, 66 and 67 include a longitudinal recess which provides a bore or passage 68 through the annular member 65 and the extensions 66, 67 when the member 65 is assembled in the housing 20 as shown in FIGS. 3–4 of the drawings.

Suitable means such as a snap-ring 70 may be positioned in the annular groove 71 for retaining the member 65 in position while enabling each member 65 to be readily removed along with the support means 40 and latch means 30 for a purpose as will be described in greater detail hereinafter.

The upper end portion of housing means 21 is threaded to receive a closure thereon, if desired. An opening through the closure accommodates movement of cable C. Suitable spaced seal means 41, 42 are provided between the housing means 21 and the support means 40 to inhibit leakage and to provide an arrangement for accommodating longitudinal movement of the support means 40 when desired to effect release of the latch means 30 from the tool trapped thereby.

The bore 68 receives the wire line or slick line designated C therethrough which is connected with the fishing neck 35 on the upper end of the tool 15, and the bore 68 permits the cable C to move so that the tool 15 to be lowered into the well bore as desired and then retrieved and latched in position as will be described hereinafter.

Release means for disengaging the latch means 30 from the fishing neck 35 connected to the upper end of the tool 15 are provided. Such release means constitute in part the annular support member or means 40, as well as means for effecting longitudinal movement thereof along with the latch means 30 from the position illustrated in FIG. 3 of the drawings to the position illustrated in FIG. 4 of the drawings, wherein the lower end 36 of the latch members 31 are moved off the radially inwardly extending ledge or shoulder means 27 in bore 25 up into the larger diameter portion of the bore 25, as shown in FIG. 4, so that such fingers may spread apart to enable the fishing neck 35 to be disengaged from the shoulder 34 on the latch members 31.

In FIGS. 3 and 4, the means for effecting longitudinal movement of the support means or member 40 and latch means 30 supported thereon against the force of the spring 50, include the port means 47 connected by means of conduit 49 with a source of hydraulic or pneumatic fluid under pressure, represented schematically at 48. Suitable valve means represented at 49*a* in the conduit 49 may be actuated to control the flow of pressure fluid between the source 48 and to the bore 25 between the spaced seal means 41 and 42. Since the seal means 41, 42 are arranged on different diameters of the bore 25 in housing 21, as shown in the drawings, fluid pressure injected between the seal means through the port 47 will act to effect upward movement of the member 40 and latch means 30 against the force of spring means 50. Conversely, fluid pressure from the well bore within the lubricator housing 13 will act on the seal means 41 in a manner to retain the annular support means 40 in its lowermost position, illustrated in FIG. 3 of the drawings, while the tool 15 is being lowered into the well bore on the cable C and retrieved from the well bore. Annular shoulder means 29*a* are provided in the bore 25 between the seals 41, 42 to engage the annular shoulder 40*a* on the support means 40 and limit downward movement thereof by spring means 50 as illustrated in FIG. 3. Similarly, upward movement of the latch means 30 and support member 40 is limited by reason of engagement of the upper end or surface 33*a* of the annular projecting portions 33 on the upper end of the latch means 30 and by reason of engagement of the upper end 40*b* of the support means 40 with the annular shoulder 29*c* formed in the bore 25 and spaced from the bottom of annular member 65.

Figure 5:
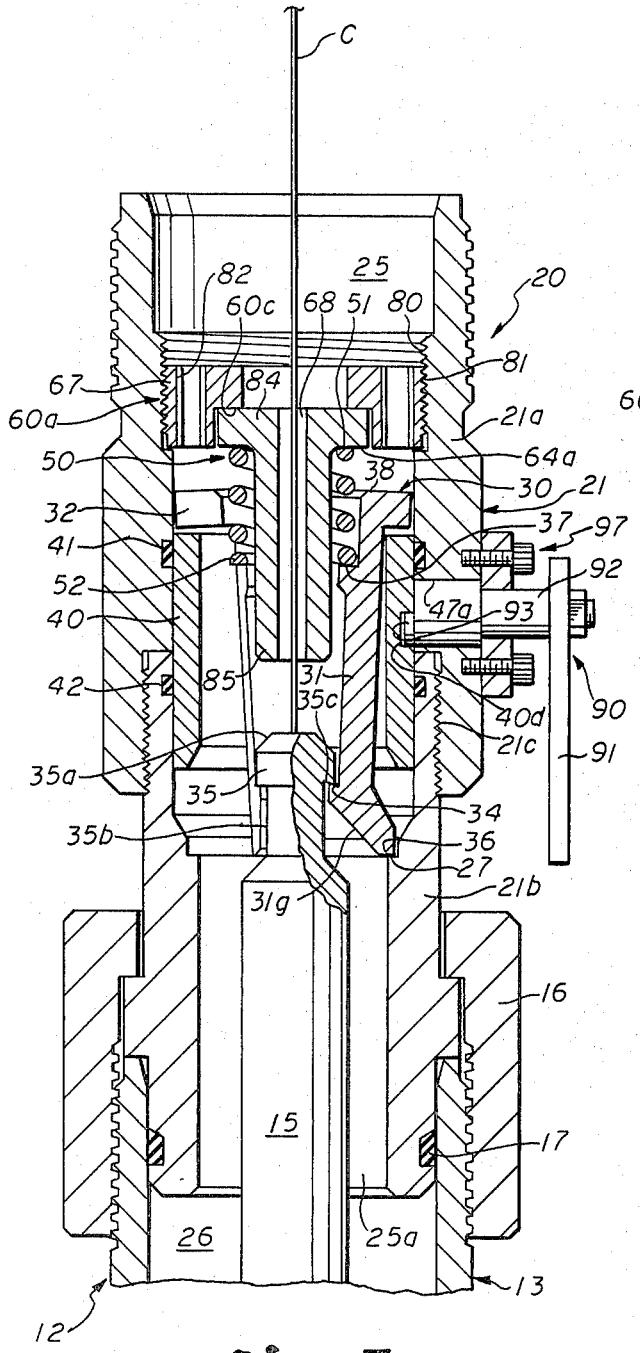
FIG. 5 is an alternate embodiment of the present invention showing a tool latched or trapped thereby.
Figure 6:
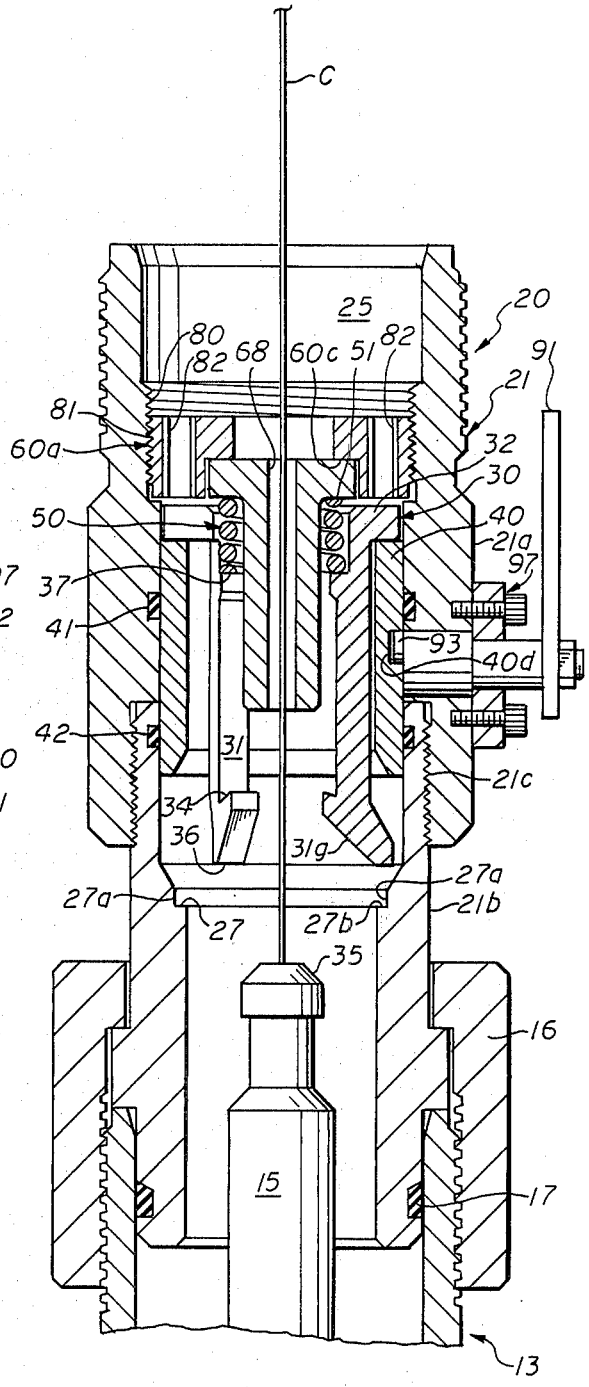
FIG. 6 is a sectional view illustrating the embodiment of FIG. 5 and the release means actuated to enable the latch means to be unlatched from the tool.

FIGS. 5 and 6 show an alternate embodiment which incorporates a housing means 20, constructed as illustrated in FIGS. 3 and 4. Annular latch support means 40 are provided in the bore 25 of the housing 20 for supporting the latch means 30 in a manner as described with regard to FIGS. 3 and 4. The latch members 31 are similar in arrangement, construction and operation to that described with regard to FIGS. 3 and 4.

The annular member 60*a* in the FIGS. 5 and 6 modification is of one piece construction and is secured in the longitudinal bore or passageway 25 of the housing 21 by means of the threads 80 on the bore 25 and cooperating threads 81 on the exterior of the annular member 60*a*. Noncircular openings 82 are provided in the member 60*a* to be engaged by any suitable means to effect rotation of such member to position it as shown in FIGS. 5 and 6 of the drawings and to disengage it from the bore 25.

In this embodiment, a separate member 84 is provided with a central, longitudinally extending projection 85, which member is seated in the annular recess 60*c* formed in the member 60*a* as shown in the drawings and depends from the annular member 60*a*. A bore 68 similar to the bore 68 of the FIGS. 3, 4 modification is provided through the depending projection 85 through which the cable means C is received to enable the tool 15 to be lowered into the well and to be retrieved therefrom. The projection means 85 is also surrounded by the spring means 50 with one end of 51 of the spring abutting the surface 84*a* of the member 84 and the other end 52 abutting the shoulder 37 on the latch members 31 as described with regard to FIGS. 3 and 4.

The release means for the FIGS. 5, 6 modification includes the annular support member 40 and an alternate form of means which cooperates with the member 40. Such alternate form is shown as including the crank means referred to generally by the numeral 90, including the crank arm 91, shaft 92 which extends through aperture or opening 47*a* of the housing means 21 and projection 93 on the end of such shaft means 92, which is received within a conforming recess 40*d* formed in the outer surface of annular member 40. The crank means 90 may be either manually actuated or power-actuated and when the lever 91 is moved from the position shown in FIG. 5 of the drawings to the position shown in FIG. 6 of the drawings, this shifts the member 40 from the position illustrated in FIG. 5 upwardly along with the latch means 30 against the force of the spring means 50 to the position shown in FIG. 6. Any suitable means, as represented generally at 97, may be employed for securing the crank means 90 in position on the housing means 21.

While it is believed that the operation of the invention is apparent from the foregoing description, it will be assumed that the lubricator housing 13 is to be secured on the blowout preventer 11 with the tool 15 therein and connected to cable C, as illustrated in FIG. 1 of the drawings. Initially, however, the lubricator 12 will be on the ground and ready for assembly with the tool 15 and the present invention.

Generally, the portion 15*a* of the tool 15 may be anywhere from one foot to 60 feet long and comprises in part sinker bars which are weighted members to enable the tool 15 to move freely downwardly through the well bore 15 when the blowout preventer 11 is actuated to open and permit the tool to pass therethrough. The extent of housing portion 26*a* of the lubricator 12 will be sufficient to accommodate tool portion 15*a*, and the extent and diameter of housing portion 26*b* will accommodate tool portion 15*b*.

The tool portions 15*a* and 15*b* may be secured together when they are resting on the ground whereupon the cable C to which is connected a cable, or rope socket and the fishing neck 35 are inserted through the bore 25 of housing means 20 connected to the upper end of lubricator housing portion 26*a*. The cable C, rope socket and fishing neck are then pulled downwardly through the bore 26 of the upper lubricator housing portion 26*a* and through the lower lubricator housing portion 26*b* when they are secured together and resting on the ground before connection to the top of the blowout preventer 11 or wellhead 10, as the case may be. The cable C, rope socket and fishing neck 35 are then connected with the upper end of tool portion 15*a* by means well known in the art. Generally speaking, the portion 15*a* of the tool is uniform in diameter throughout its longitudinal extent, regardless of the diameter of tool portion 15*b* although tool portion 15*b* may vary in diameter depending upon the type of tool to be run.

The foregoing is advantageous in that it permits the cable C, whether it is a wire line or slick line to be connected to its socket and the fishing neck and then inserted through the lubricator housing for connection with the tool.

The tool trap of the present invention will generally have the housing means 21 secured adjacent the upper end of lubricator housing portion 26*a* before the lubricator 12 is secured as shown in FIG. 1. After the cable C and socket have been pulled through housing means 21 and lubricator 12 for connection with tool portion 15*a*, the components of the present invention will be assembled in housing means 21. Annular means 40, if it has not previously been, can be positioned in bore 25 with seals 41, 42 in place. Latch members 31 are then inserted in bore 25 to rest on shoulders 37. Parts 61 and 62 are then positioned in bore 25 around cable C and on spring 50 and snap ring 70 inserted in groove 71. This will cause spring 50 to urge latch members 31 down to seat their ends 36 on shoulder 27 so that they are in collapsed position ready to engage fishing neck 35 on tool 15.

The tool 15 is then pulled up into lubricator housing 13 and the fishing neck head 35*a* will strike upwardly tapered surfaces 31*g* on latch members 31 and move latch members 31 up against spring 50. As the latch members move up, they move off seat 27 and move from the smaller diameter defined by 27*a* into larger diameter bore 25. However, as soon as head 35 has cleared projections 34, spring 50 will force latch members down onto seat 27 which collapse them inwardly to engage with shoulder 34 and trap tool 15.

The lubricator 12 with the trapped tool 15 is secured in position, as illustrated in FIG. 1, adjacent the well bore upper end. In FIG. 1, the lubricator 12 is shown as being connected to the wire line blowout preventer 11 by the flange means and bolt means represented at F.

The release means, either hydraulic, pneumatic or mechanical, or any other suitable power actuation, may be actuated to shift the support member 40 longitudinally to enable the latch members 31 to to shift from the position shown in FIG. 3 to the position shown in FIG. 4, whereupon the weighted sink bars in the portion 15*a* of the tool cause it to fall within lubricator 12 of the well bore (not shown).

After the tool 15 has performed its desired function, then it is retrieved to the top of the well bore, and it is not uncommon for the tool 15 to impact against the top closure of the lubricator with sufficient force to part the cable C as it is pulled into lubricator 12. In prior art devices, the tool 15 thereupon dropped until it hit the check valve, or closure, arrangement of the prior art previously referred to, which in some instances may damage the tool. This arrangement overcomes this problem in that it contacts and latches the tool at the upper end thereof and prevents it from falling.

Also, the tool trap of the present invention functions with all tools 15 regardless of size. For example, the housing 13 of the lubricator may be of uniform diameter throughout, or it may comprise a portion 26*a*, which is of smaller diameter than the housing portion 26*b* which receives the actual tool mechanism 15*b* connected at the lower end of the tool portion 15*a*. Also, since the lubricator housing portion 26*a* is generally of one of several standard sizes, regardless of the size of the tool 15 at the lower end of the sinker bar arrangement 15*a*, only the portion 26*b* need be changed to accommodate tools of varying size.

The present invention enables the tool trap to be tested before the tool is released and run into the well bore to assure that it is functioning properly. Also, the present invention incorporates release means to release and maintain the latch means in released position from the trapped tool, whereby the trapped tool may be readily and easily disengaged from the latch means and removed from the lubricator if desired.

The fishing neck 15 is arranged on the upper end of the tool portion 15*a* as shown in FIG. 1 of the drawings, and thus the tool trap of the present invention always engages the upper end of the tool 15 and retains it so that even if the cable means C should become parted, the latch means will remain operative to retain the tool latched until the release means is actuated as previously described herein.

The foregoing disclosure and description of the invention are illustrative and explanatory thereof, and various changes in the size, shape and materials, as well as in the details of the illustrated construction may be made without departing from the spirit of the invention.

What is claimed is:

1. A tool trap for securing adjacent the upper end of a lubricator to latch with the fishing neck on the end of a wire line tool comprising:

a. housing means for positioning adjacent the upper end of the lubricator, said housing means including a longitudinal bore;

b. latch means supported in said housing means for latching with the fishing neck on the end of the wire line tool, said latch means including:

1. a plurality of latch members extending longitudinally of said housing means;
2. spring means supported in said housing means and urging said latch members longitudinally of said housing means in one direction;
3. means in said housing means to limit longitudinal movement of said latch members in said one direction and to position said latch members in tool trapping relation; and
4. surface means on said latch members engageable by the fishing neck on the tool to be trapped so that continued tool movement moves said latch members in the other direction in said housing means against the force of said spring means to thereby spread said latch members for thereafter latching with the fishing neck when said spring means urges said latch members in said one direction of said housing means;

c. release means supported by said housing means and movable to engage and unlatch said latch means from the fishing neck on the end of the wire line tool, said release means including:

1. annular piston means sealably positioned in the bore of said housing means and engageable with said latch means; and
2. actuating means including port means in said housing means for conducting fluid pressure to move said annular piston means and said latch means longitudinally of said housing means to thereby release the latch means from the trapped tool.

2. The tool trap of claim 1 including seal means between said annular piston means and said housing means on each side of the port means.

3. A tool trap for positioning adjacent the upper end of a lubricator to latch with the fishing neck on the end of a wire line tool comprising:

a. housing means for positioning adjacent the upper end of the lubricator, said housing means having a longitudinal bore therethrough;

b. latch means supported in said housing means for latching with the fishing neck on the end of the wire line tool;

c. latch support means supporting said latch means in the bore of said housing means;

d. spring means abutting said latch means and urging said latch means and support means longitudinally of said housing means bore in one direction;

e. seat means projecting inwardly in the bore in said housing means to limit longitudinal movement of said latch means in said one direction and to position said latch means in tool trapping relation;

f. spring support means supporting said spring means;

g. surface means on said latch means engageable by the fishing neck on the tool to be trapped so that said latch means may be moved longitudinally in the other direction in said housing means bore against the force of said spring means and spread for latching with the fishing neck; and h. means to move said latch support means and said latch means supported thereby against the force of said spring means to release said latch means from the trapped tool, said means comprising crank means engaged with said latch support means and extending outwardly of said housing means whereby rotation of said crank means shifts said latch support means and latch means longitudinally of said housing means to move said latch means off said seat means and into the housing bore thereabove to release the latch means from the trapped tool.

4. The tool trap of claim 3 wherein said spring support means includes members releasably secured together and there being an opening through said spring support means to receive the wire line therethrough.

5. The tool trap of claim 3 wherein said spring support means includes members releasably secured together, said spring support means including projecting means extending longitudinally of said housing means which projects into said spring means.

6. The tool trap of claim 4 including means to releasably secure said support means in said housing means.

7. The tool trap of claim 3 wherein said spring support means includes shoulder means on said latch means.

8. A tool trap for positioning adjacent the end of a lubricator to latch with the fishing neck on the end of a wire line tool comprising:

a. housing means for positioning adjacent the upper end of the lubricator, said housing means having a longitudinal bore therethrough;

b. latch means for latching with the fishing neck on the end of the wire line tool;

c. latch support means supporting said latch means in the bore of said housing means;

d. spring means supported in the bore of said housing means to urge said latch means in one direction in said housing means;

e. seat means in said housing means urging said latch means inwardly toward each other within the housing bore when urged in said one direction by said spring means;

f. surface means on said latch means engageable by the fishing neck on the tool to be trapped which spreads said latch means apart to enable the fishing neck to move into the latch means and be engaged thereby;

g. release means supported by said housing means for movement longitudinally thereof in the other direction to move said latch means off said seat means whereby said latch means may spread and release the trapped tool; and h. means to transmit power externally of said housing means to move said release means longitudinally.

* * * * *